US005410842A

United States Patent [19]

Watson

[11] Patent Number: 5,410,842

[45] Date of Patent: May 2, 1995

[54] TWO SPEED HYDRAULIC DOOR OPERATOR

[75] Inventor: Joel W. Watson, Oconomowoc, Wis.

[73] Assignee: ASI Technologies, Inc., Milwaukee, Wis.

[21] Appl. No.: 152,623

[22] Filed: Nov. 12, 1993

[51] Int. Cl.[6] ..... E05F 15/02

[52] U.S. Cl. ..... 49/360; 60/494

[58] Field of Search ..... 49/360, 138, 118, 123, 49/334, 324; 60/468, 464, 494; 91/399

[56] References Cited

U.S. PATENT DOCUMENTS

| | | | |
|---|---|---|---|
| 3,126,706 | 3/1964 | Dettinger . | |
| 3,210,065 | 10/1965 | Linder et al. | 49/334 X |
| 3,864,911 | 2/1975 | Gellantly et al. | 60/430 |
| 3,877,347 | 4/1975 | Sheesley et al. | 91/438 |
| 4,194,365 | 3/1980 | Stoufflet et al. | 60/494 X |
| 4,296,570 | 10/1981 | Balbach et al. | 49/360 |
| 4,476,678 | 10/1984 | Hall | 49/18 X |
| 4,494,376 | 1/1985 | Beaufort | 60/421 |
| 4,782,662 | 11/1988 | Reeves et al. | 60/494 X |
| 5,293,747 | 3/1994 | Geiger | 60/494 X |

OTHER PUBLICATIONS

Aluma Shield Industries, Inc. Drawing Dated Dec. 3, 1992 and entitled "Dual Speed Hydraulic Operator".

*Primary Examiner*—Philip C. Kannan
*Attorney, Agent, or Firm*—Quarles & Brady

[57] ABSTRACT

A hydraulic door operator includes a reversible hydraulic pump driven by an electric motor and connected in a closed loop to a reversible hydraulic motor which operates the door. A bypass valve assembly is connected across the loop between the pump and hydraulic motor. The bypass valve assembly is operative when fluid is delivered by the pump to drive the motor in one direction so that a portion of the fluid flow is bypassed from reaching the motor. When the pump is operated to deliver fluid to drive the motor in the opposite direction, the bypass valve assembly is inoperative. When operative, the bypass assembly will cause the motor to be driven at a slower speed than it will be driven when the bypass valve assembly is inoperative.

10 Claims, 2 Drawing Sheets

TWO SPEED HYDRAULIC DOOR OPERATOR

BACKGROUND OF THE INVENTION

This invention relates to industrial door operators, and particularly to a hydraulic control system for the door operator which provides different speeds in opening and closing the door.

Door operators are used to open and close doors that are mounted for swinging or sliding movement between open and closed positions, or for doors that are mounted to unroll and roll-up for closing and opening door openings. The industrial doors may be used for a variety of purposes such as closing the entry ways to cold storage environments. The industrial doors, especially those used for cold storage purposes, are usually either a single panel or a by-parting sliding panel which is moved by a mechanical drive system that includes a chain loop above the doors and a reversible motor for driving the chain.

Hydraulic systems for door operators have been proposed. Examples of hydraulic door operators are found in U.S. Pat. No. 4,296,570 issued Oct. 27, 1981 to George C. Balbach, et al. and assigned to the assignee of this invention. In such hydraulic systems, a reversible hydraulic pump, driven by an electric motor, is connected by a closed loop to a reversible hydraulic motor which in turn drives the mechanical drive for the door.

The speed of operation of the door is very important. When the doors are used in a cold storage environment, they must be kept open for the shortest possible duration consistent with safety. Typically, the door will be driven open at a very rapid speed and will be closed at a second slower speed to ensure pedestrian and vehicle clearance through the door opening before closing occurs. In hydraulic door operators, this two-speed operation (i.e. one speed for opening and a second slower speed for closing) has typically been accomplished by using a two-speed electric motor to drive the hydraulic pump. The pump is driven at one speed to power the motor to drive the door to an open position, and the pump is driven at a second slower speed to power the motor to drive the door to a closed position.

Another suggested way to achieve two-speed operation in a hydraulic door operator is to insert a restricted orifice in a connection between the pump and the motor so that when fluid flow is delivered by the pump to drive the motor in a direction to close the door, the fluid flow is forced through the restricted orifice and the flow is reduced, thereby driving the motor at a slower speed. The restricted orifice is not in the flow path of fluid delivered to the door in a direction to drive the motor to open the door. Since the amount of flow delivered to the motor is governed by the flow that can be generated through the restricted orifice, a single speed electric motor can be used to power the hydraulic pump and the pump can be driven at the same speed regardless of whether the pump is driving the motor to open or close the door.

The use of a two-speed electric motor has the disadvantage of cost in that such motors are significantly more costly than single speed motors. The use of a restricted orifice to restrict flow between the pump and the motor has the disadvantage that it generates considerable heat buildup due to the back pressure that the restricted orifice creates.

SUMMARY OF THE INVENTION

It is a principal object of the invention to provide a two-speed hydraulic door operator which uses an inexpensive single-speed electric motor and does not generate heat by restricting flow.

It is another object of the invention to provide a reliable and inexpensive two-speed hydraulic door operator.

These objects are achieved by the use of a bypass valve assembly connected between the pump and hydraulic motor and operative to bypass a portion of the fluid flow from the pump to the motor when the pump is driving the motor to close the door. The bypassed flow is returned to the pump so that the motor sees a reduced flowrate and is thereby driven at a reduced speed.

The bypass valve may be disconnected from operation by a check valve when fluid flows from the pump to the hydraulic motor in a direction to drive the motor to open the door so that full fluid flow is directed to the motor during opening.

Preferably, the bypass valve is adjustable so that the proportion of flow that is bypassed from reaching the motor can be varied, and the speed of operation of the motor during closing can thereby be varied.

The connection of the bypass valve can also be reversed so that a faster speed is achieved during closing than during opening.

The foregoing and other objects and advantages of the invention will appear from the detailed description of the preferred embodiment which is illustrated on the accompanying drawings.

DESCRIPTION OF THE PREFERRED EMBODIMENT

Figure 1:
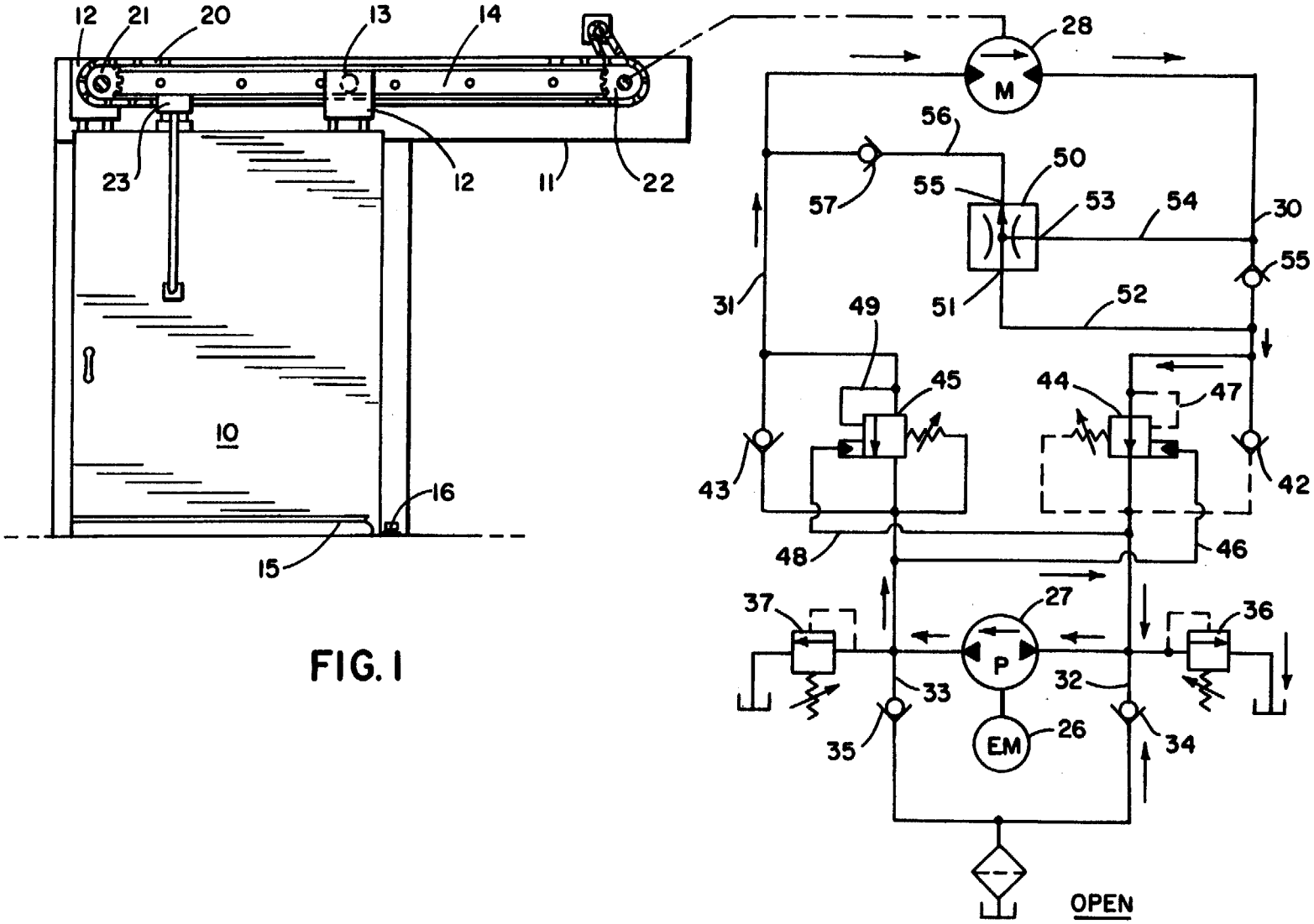
FIG. 1 is a schematic diagram of a hydraulic door operator connected to an industrial door and showing the directions of flow of fluid within the hydraulic circuit as the door is opened.

Referring to FIG. 1, a schematic door assembly is shown on the left side of the figure and a hydraulic door operator mechanism is shown on the right side. The door assembly includes a door 10, shown in closed position, that is slidably suspended for sideward movement in a vertical plane on a horizontal frame 11. The door 10 is hung from the frame 11 on a pair of door trucks 12 each of which includes a bearing wheel 13 which runs along a horizontal guide rail 14. The door 10 includes a flange 15 along its bottom edge which runs over a guide wheel 16 mounted on the floor to guide the bottom of the door 10.

Above the door 10 is a endless loop drive chain 20 used to draw the door 10 between its open and closed positions. The chain 20 is looped around an idler sprocket 21 and a drive sprocket 22. The door 10 may be connected to the chain loop 20 by a chain pickup clamp 23 mounted on the top of the door 10. The pickup clamp 23 may be disengaged from the drive chain 20 by pulling on a safety release cord 24 so that the door 10 is capable of being manually opened and closed independently of the chain drive 20, in a known manner.

The door 10 may be typically a cold storage door of the single panel type, as shown in FIG. 1, or it may be a bi-parting door in which a pair of doors slide horizontally in a vertical plane apart from one another in their opening cycle. The door may also be of the overhead door type, a swinging door type, or a roll-up door type, and the present invention may be employed with any of these various types of doors.

The chain loop 20 is driven by the hydraulic door operator which includes an electric motor 26, a reversible hydraulic pump 27, and a reversible rotary hydraulic motor 28. The electric motor 26 is controlled by an electric control circuit (not shown) which may take the form of the circuit shown in U.S. Pat. No. 4,296,570. A pair of hydraulic control lines 30 and 31 form a closed loop between the pump 27 and motor 28. The first control line 30 extends from the right side of the pump 27 to the right side of the motor 28 and the second control line 31 extends from the left side of the pump 27 to the left side of the motor 28. The two sides of the pump are also connected to input lines 32 and 33 containing check valves 34 and 35, respectively, which lead to a hydraulic reservoir or sump. The check valves 34 and 35 permit hydraulic fluid to be drawn from the reservoir or sump, while preventing the fluid from flowing back into the reservoir through the line 32 or 33.

A pair of start cushioning valves 36 and 37 are connected to the control lines 30 and 31. These valves take the form of adjustable pressure relief valves. If a control line pressure is greater than a predetermined value in either of the lines 30 or 31, the associated valve 36 or 37 opens to relieve pressure in the control line by bypassing hydraulic fluid to the reservoir until line pressure drops to a predetermined value. The start cushioning valves 36 and 37 thereby reduce the initial peak pressure surge that may develop in the control lines 30 or 31 when the pump 27 is started by the electric motor 26. The start cushioning valves 36 and 37 are normally adjusted to close after start-up so that fluid flow is confined from the pump 27 to the motor 28 and back to the pump 27.

A second set of check valves 42 and 43 are disposed in the control lines 30 and 31, respectively. These check valves 42 and 43 permit hydraulic fluid to pass from the pump 27 to the motor 28, but not in the reverse direction, and they provide a locking mechanism for the door 10, so that when the flow of hydraulic fluid through the system from the pump 27 stops, fluid cannot escape from the motor 28 and thereby locks the motor is thereby locked against rotation.

Also disposed in the control lines 30 and 31 are a pair of stop cushioning valves 44 and 45. The valves 44 and 45 are disposed in the control lines 30 and 31 in parallel with the check valves 42 and 43, respectively. Each of the stop cushioning valves 44 and 45 consists of a combination relief and check valve. The stop cushioning valve 44 includes a pair of pilot lines 46 and 47. The pilot line 46 of the valve 44 senses pressure in control line 31 and the other pilot line 47 senses the pressure in control line 30. The valve 44 acts as a relief valve by sensing the high pressure in control line 31 when the pump 27 is supplying hydraulic fluid under pressure to rotate the motor 28 in a direction to open the door 10, as shown in FIG. 1, and the valve 44 opens to permit the fluid to return from the motor to the pump 27. The stop cushioning valve 44 also acts to ensure smooth stopping of the door 10 by the pilot line 47 sensing high pressure in the control line 30. When the pump 27 stops, the hydraulic motor 28 will continue to turn for a short time thereafter thereby building up pressure in control line 30 which is sensed to keep the valve 44 open to pass fluid back to the pump 27. Similar pilot lines 48 and 49 connect the second stop cushioning valve 45 to the control lines 30 and 31, respectively.

What has been described thus far does not differ in any essential manner from that shown and described in the earlier U.S. Pat. No. 4,296,570. Reference should be had to that patent for further details on the construction and operation of the hydraulic circuit. The hydraulic door operator of the earlier patent if driven by a single-speed hydraulic motor would operate to drive the hydraulic motor at the same speed in each direction. As a result, the door would be opened and closed at the same speed. There are definite advantages to providing a slower closing speed than that used for opening. A principal advantage is concern for safety of pedestrians and vehicles that are passing through the door opening. A slower closing speed can be established to ensure that pedestrians and vehicles can clear the opening before the door is closed. In the prior hydraulic door operator, two-speed operation was accomplished by the use of a two-speed electric motor to drive the hydraulic pump. Such motors are expensive compared to single speed motors.

The present invention adds a bypass valve assembly connected across the control lines 30 and 31 to provide a lower volume of flow from the pump to the motor when the motor is being driven in a direction to close the door. The bypass valve assembly includes a bypass valve 50 having an inlet port 51 connected by a line 52 to the first control line 30. A first outlet port 53 is also connected to the control line 30 by a line 54. A check valve 55 is disposed in the control line 30 between the connections of the lines 52 and 54 so that flow from the right side of the pump 27 to the motor 28 through the first control line 30 must pass to the inlet part 51 of the bypass valve 50. The bypass valve 50 includes a second outlet port 55 which is connected to the second control line 31 by a line 56 that includes a check valve 57. The check valve 57 ensures that fluid under pressure being delivered by the pump 27 to the motor 28 through the second control line 31 will not be applied to the second outlet port 55 of the bypass valve 50.

The bypass valve 50 is a commercially available product. A suitable valve may be the Priority Flow Control Valve, Model FRCA-XAN or FRDA-XAN available from Sun Valve Company, or the adjustable versions of such valves identified by the suffix LAN.

Figure 3:
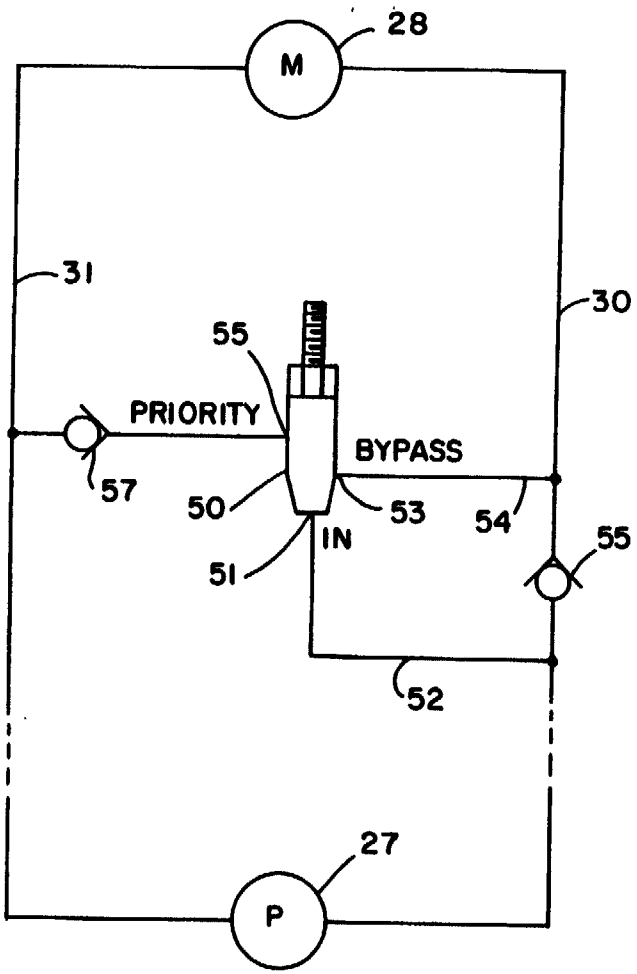
FIG. 3 is a schematic view of an adjustable bypass valve useable in practicing the invention.

The bypass valve 50 functions by bypassing a portion of the flow from the inlet port 51 to the first outlet port 53 when the flow through the valve 50 to the second outlet port 55 exceeds a priority pressure which is either established or subject to adjustment. In the adjustable version of the bypass valve, the priority pressure to the second outlet port 55 that will trigger bypassing can be adjusted, typically to plus and minus 25% of a baseline value. The adjustable version of the bypass valve is shown in schematic form in FIG. 3.

In operation, during an open door cycle of operation, fluid under pressure is delivered by the pump 27 to the motor 28 through the second control line 31 in a normal manner. The bypass valve assembly is not operative because the check valve 57 prevents flow to the bypass valve 50 from the control line 31 and the pressure in the bypass line 54 from the first outlet port 53 is less than the pressure at the second outlet port 55. The path of least resistance is therefore through the check valve 55 and the first control line 30. The motor 28 will therefore drive the door 10 open at a full speed.

Figure 2:
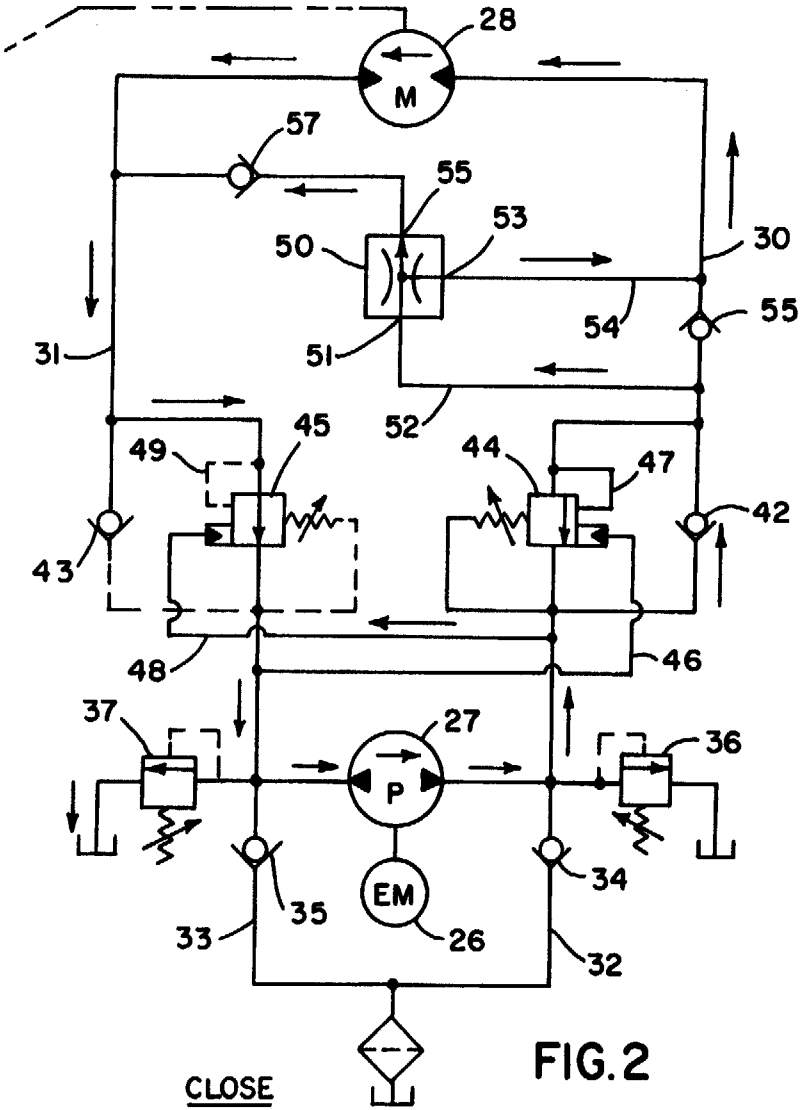
FIG. 2 is a schematic diagram of the hydraulic door operator of FIG. 1 and showing the directions of flow of fluid as the door is closed.

When the electric motor 28 drives the pump 27 in the direction to cause the door 10 to be closed, the flow paths of fluid are those shown in FIG. 2. Flow from the pump 27 to the motor 28 through the first control line 30 is blocked by the check valve 55 so that the entire flow must pass to the inlet 51 of the bypass valve 50. A portion of that flow will exit the first outlet port 53 and return to the first control line 30 to drive the motor 28. Another portion of the flow from the pump 27 will be pass to the second outlet port 55 and back to the second control line 31 thereby bypassing the motor 28. Since the motor 28 receives reduced flow, it will be driven at a slower speed as it closes the door 10. In the adjustable version, the proportion of fluid that is diverted from reaching the motor 28 can be adjusted and the speed of operation of the motor 28 can thereby be adjusted.

Although the invention has been described as providing a second, slower speed of operation upon closing of the door, it could also be used to provide a second, slower speed upon opening of the door if the need for such form of operation arises. Such an adaptation could be easily accomplished by connecting the bypass valve so that it is blocked during closing and operative during opening.

I claim:

1. In a door operator having a hydraulic system for opening and closing the door including a reversible hydraulic motor connected to a pump through a pair of hydraulic lines that are selectively connected to the output of the pump to drive the motor in one direction to open the door and in an opposite direction to close the door, the improvement wherein:

a bypass valve assembly is connected across the hydraulic lines between the pump and motor to bypass a portion of the flow from the pump to the motor when the pump output is connected to rotate the motor in a direction that will close the door.

2. A door operator in accordance with claim 1 together with a check valve that operatively disconnects the bypass valve from across the hydraulic lines when the pump output is connected to rotate the motor in a direction that will open the door.

3. A door operator in accordance with claim 1 wherein the bypass valve is adjustable to vary the proportion of flow from the pump that does not reach the motor.

4. A door operator having a hydraulic system for opening and closing the door, comprising:

a reversible hydraulic pump;

a reversible hydraulic motor;

a closed hydraulic loop connecting the motor to the pump; and a bypass valve assembly connected across the loop between the pump and motor, said bypass valve assembly including a bypass valve that is operative when the pump operates in a direction to deliver fluid under pressure to the motor to drive the motor in a direction to close the door, said bypass valve when operative diverting a portion of the flow across the loop to thereby bypass the motor.

5. A door operator in accordance with claim 4 wherein the bypass valve assembly further includes a check valve that operatively disconnects the bypass valve when the pump operates in a direction to deliver fluid under pressure to the motor to drive the motor in a direction to open the door.

6. A door operator having a hydraulic system for opening and closing the door, said system including:

a hydraulic pump;

a reversible hydraulic motor;

a first hydraulic line connecting the pump to the motor to deliver fluid under pressure to drive the motor to close the door;

a second hydraulic line connecting the pump to the motor to deliver fluid under pressure to drive the motor to open the door;

a bypass valve having an inlet and first and second outlets, the flow through the inlet being divided between the first and second outlets, the inlet and the first outlet being connected to the first hydraulic line, and the second outlet being connected to the second hydraulic line; and a check valve in the connection between the second outlet and the second line to block fluid flow from the second line to the bypass valve.

7. A door operator in accordance with claim 6 together with a check valve in the first line to force fluid flow from the pump into the first line to the inlet of the bypass valve.

8. A door operator in accordance with claim 6 wherein the bypass valve is adjustable to vary the division of flow between the first and second outlets.

9. In a door operator having a hydraulic system for opening and closing the door including a reversible hydraulic motor connected to a pump through a pair of hydraulic lines that are selectively connected to the output of the pump to drive the motor in one direction to open the door and in an opposite direction to close the door, the improvement wherein:

a bypass valve assembly is connected across the hydraulic lines between the pump and motor to bypass a portion of the flow from the pump to the motor when the pump output is connected to rotate the motor in one of the directions, and the bypass valve assembly is inoperative to bypass a portion of the flow when the pump output is connected to rotate the motor in an opposite direction.

10. A door operator in accordance with claim 9 wherein the bypass valve is adjustable to vary the proportion of flow from the pump that does not reach the motor.

* * * * *